United States Patent [19]

Kroessler

[11] Patent Number: 4,613,792

[45] Date of Patent: Sep. 23, 1986

[54] SYMMETRICAL LOAD POWER REDUCTION DEVICE FOR LIGHTING FIXTURES

[76] Inventor: Peter R. Kroessler, 2532 Singing Vista Way, El Cajon, Calif. 92021

[21] Appl. No.: 659,278

[22] Filed: Oct. 10, 1984

[51] Int. Cl.[4] ..... H05B 39/00; H05B 41/14

[52] U.S. Cl. ..... 315/97; 315/94; 315/105; 315/278; 315/227 R; 333/32

[58] Field of Search ..... 315/97, 96, 95, 94, 315/278, 277, 105, 103, 227, 240; 333/32, 35

[56] References Cited

U.S. PATENT DOCUMENTS

| | | | |
|---|---|---|---|
| 2,558,293 | 6/1951 | Feinberg | 315/100 |
| 2,683,243 | 7/1954 | Feinberg | 315/138 |
| 2,774,010 | 12/1956 | Feinberg | 315/138 |
| 2,788,469 | 4/1957 | Feinberg | 315/138 |
| 2,864,035 | 12/1958 | Davis | 315/97 |
| 2,883,581 | 4/1959 | Feinberg | 315/132 |
| 2,892,249 | 6/1959 | Feinberg et al. | 29/155.61 |
| 2,920,237 | 1/1960 | Berger | 315/138 |
| 2,971,124 | 2/1961 | Feinberg et al. | 315/97 |
| 3,003,081 | 10/1961 | Huberty et al. | 315/257 |
| 3,023,385 | 2/1962 | Feinberg et al. | 336/165 |
| 3,089,981 | 5/1963 | Roesel | 315/98 |
| 3,125,795 | 3/1964 | Feinberg et al. | 315/278 |
| 3,629,648 | 12/1971 | Brown | 315/98 |
| 3,954,316 | 5/1976 | Luchetta | 315/96 |
| 3,989,335 | 11/1975 | Belokin | 339/50 |
| 4,082,981 | 4/1978 | Morton et al. | 315/97 |
| 4,135,115 | 1/1979 | Abernethy et al. | 315/97 |
| 4,163,176 | 7/1979 | Cohen et al. | 315/53 |
| 4,255,692 | 3/1981 | Burgess | 315/187 |
| 4,317,069 | 2/1982 | Burgess | 315/227 |

FOREIGN PATENT DOCUMENTS

| | | | |
|---|---|---|---|
| 0249468 | 6/1960 | Australia | 315/97 |
| 0310357 | 10/1971 | U.S.S.R. | 333/32 |

*Primary Examiner*—Saxfield Chatmon

*Attorney, Agent, or Firm*—Brown, Martin & Haller

[57] ABSTRACT

A device to reduce power consumption in a rapid-start fluorescent lighting fixture having one or more lamps and a conventional ballast. The device includes a step-up isolation transformer, a capacitor connected in parallel with a bleed resistor and in series with a protective fuse all across the transformer. The device being mounted external of the ballast and wired in series between the ballast and the filament of a lamp to present a symmetrical load to the ballast circuit. In one embodiment the capacitor of the device is connected between the primary and secondary windings of the transformer by taps intermediate of the windings with an optimum connection at the center taps of the windings. In a second embodiment the capacitor is connected between either lead of the primary winding of the transformer and the center tap of the secondary winding. In a third embodiment the connection of the capacitor is made between either input lead of the transformer's primary winding and the electrically opposite lead of the transformer's secondary winding.

11 Claims, 5 Drawing Figures

SYMMETRICAL LOAD POWER REDUCTION DEVICE FOR LIGHTING FIXTURES

BACKGROUND OF THE INVENTION

The invention relates to a device for reducing the power consumption of a conventional fluorescent lighting installation of the type having one or more but generally two fluorescent lamps operated from a high power factor conventional ballast connected to a conventional electrical power source.

Fluorescent lamp fixtures are extensively used in domestic, business and industrial installations. Installations employing such lamps usually consist of fixtures with two lamps controlled by an encapsulated ballast which starts the lamps and maintains individual lamp filament voltages and currents as specified by the fixture manufacturer. A typical ballast and two lamp fixture has lamp filament, or cathode, voltages of 3.1 to 3.8 volts at a current of 0.750–1.2 amperes. The voltages across the lamps after warm up are 98–102 volts with a current of approximately 0.4 ampere. The power consumption of such lighting installations is significant, and because of their extensive coverage and prolonged use, various methods and devices have been employed to reduce the cost by limiting the power consumed by the lamps.

A procedural method to reduce lighting costs is to remove some of the lamps from the installation fixtures and replace them with non-illuminating, but conducting tubes as disclosed in the patent to Burgess, U.S. Pat. No. 4,255,692. This procedure is generally undesirable since the illumination provided by the fixtures is greatly reduced.

An alternate approach employed to reduce lamp fixture power consumption is to add an impedence device to the fixture circuitry which is connected in series between the ballast and a lamp filament to reduce the operating current flow through the lamps. This approach has been adopted due to the difficulty of changing internal components of the standard ballast resulting from the encapsulation of the ballast. Such devices consist essentially of a standard step-up isolation transformer and a capacitor connected in the circuit between an input lead of the transformer primary and a corresponding output lead of the transformer secondary. The capacitor functions to provide increased capacitive reactance in the series circuit consisting of the ballast and lamp filaments, thus reducing the alternating current flow when the lamps are conductive. The device disclosed in U.S. Pat. No. 3,954,316 to Luchetta is representative of such a current limiting device. Although the foregoing design does achieve lamp current flow reduction in the lighting fixture, significant problems are encountered by its use. As previously mentioned, the voltage and current characteristics for the lamp filament circuits are established by the fixture and ballast manufacturer to produce optimum lighting performance. In a fixture without a power reducing device, the lamp voltages and current are designed to be of specified values and approximately equal at each lamp. The circuit parameters are altered by the addition in the fixture circuitry of a current limiting device which presents an impedence mismatch or unbalanced load created by the prior art capacitor transformer circuit of the device. In addition, the degree of unbalance is different depending upon the random connection of the device in the fixture circuitry, that is which transformer primary lead is connected to which ballast filament output lead in making the installation of the device in the lamp fixture. The variation in lamp filament voltage can be as great as 0.4 of a volt as a result of an improper connection resulting in consequent lower lamp filament voltage. Low filament voltage results in poor operating conditions, non starting, or shortened lamp life. This unbalanced voltage condition results when a random wrong choice is made in connecting the step-up isolation transformer primary leads. Thus, without great care and/or additional effort in installation, the current limiting device may be installed so as to reduce significantly lamp fixture performance.

The patent to Abernathy, U.S. Pat. No. 4,135,115, seeks to correct the intrinsic impedence mismatch possibility of the available current limiting devices by employing two capacitors connected respectively in circuit across each transformer primary input lead and secondary output lead in an effort to establish a symmetrical load. However, the provision of two capacitors adds to the size, complexity, and cost of the device.

It is desirable therefore to provide a power reduction device for use with fluorescent lamp fixtures that inherently provides for a more balanced and symmetrical electrical impedence in limiting lamp fixture current. Applicant's invention achieves this result.

SUMMARY OF THE INVENTION

According to the precepts of the invention, a symmetrical impedence load device is provided for reducing the current, and therefore the power, required in a high power factor conventional rapid start fluorescent lamp lighting fixture having series ballast. According to the invention the device is electrically connected in circuit in series between the ballast and a lamp filament winding. The placement and symmetrical electrical characteristics of the device are such as to eliminate the usual difficulties encountered in using prior art current limiting devices. One illustrated embodiment of the device includes a step-up isolation transformer having tap connections intermediate the turns of the primary winding and a tap connection intermediate the turns of the secondary winding. A capacitor is connected in circuit between the primary and secondary intermediate tap connections of the transformer, and consequently in series with the fixture ballast and lamp filaments. A special case of this embodiment has the capacitor connected between the center taps of the transformer primary and secondary windings. The reduced capacitive reactance results in the desired reduced current flow in the entire fixture circuit. The primary and secondary transformer taps are made so as to produce in combination with the capacitor an improved balanced symmetrical load using but a single capacitor. The device illustrated also includes safety features in the form of a high value resistor connected in parallel with the capacitor to bleed off the capacitor charge when the fixture is turned off, and a thermal fuse connected in series with the capacitor-resistor combination.

In a second embodiment of the invention, the device includes a step-up isolation transformer having a central tap connection in the secondary winding only. A capacitor is connected between either transformer primary input lead and the secondary winding center tap connection. The circuitry of this second illustrated embodiment of the device is also provided with the safety features described for the first embodiment.

A third illustrated embodiment of the device allows use of a transformer without intermediate winding taps while still achieving the benefits of a symmetrical load. In this embodiment effective circuit symmetry is achieved in the device by connecting the capacitor between the step-up isolation transformer primary input lead and the opposite transformer secondary output lead.

It is therefore an advantage of the invention to provide a new and improved power reduction device for fluorescent lighting fixtures. Use of the device significantly reduces the power consumption of lighting fixtures and therefore the cost of their operation with a controllable reduction in illumination. The device is compact and easily installed on a lighting fixture. The electrical circuitry of the device reflects a symmetrical load in the fixture circuitry, thus avoiding the risk of improper connection which can result in low lamp filament voltage with consequent poor lamp operation and shortened life.

DESCRIPTION OF THE DRAWINGS

The following description of the invention will be better understood by making reference to the drawings, in which like reference numerals refer to like parts throughout, and in which.

DETAILED DESCRIPTION OF THE DRAWINGS

Figure 1:
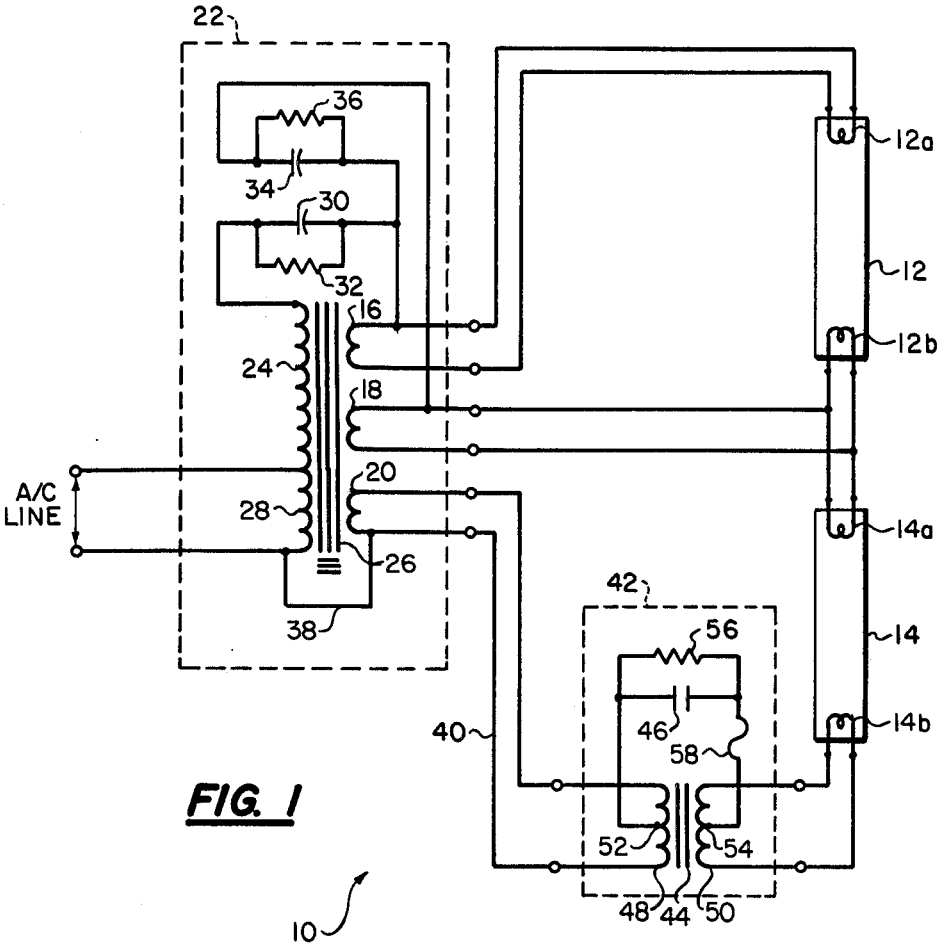
FIG. 1 illustrates schematically the connection of the power reduction device in a modified lamp fixture and depicts one circuit configuration employed in the device.

FIG. 1 illustrates schematically a typical rapid start fluorescent lighting fixture 10 including two rapid start filament lamps 12 and 14 having filaments or cathodes, 12*a* and 12*b*, and 14*a* and 14*b* respectively. For ease in lamp starting and long life, the lamp filaments are heated by filament voltages of between 2.8 to 4.2 volts and preferably 3.5 volts from filament heater coils 16, 18 and 20 of a conventional two lamp encapsulated ballast 22, illustrated within the dashed lines. The ballast 22 is used to start the lamps 12 and 14 in sequence and to maintain optimum voltages and currents in the circuitry of fixture 10 to produce designed illumination. A secondary coil 24 of the ballast 22 autotransformer 26 provides a stepped-up high voltage from the AC line connected to the transformer primary coil 28 to operate the lamps 12 and 14 in series. A capacitor 30 connected in series with the transformer secondary coil 24 and lamp filament 12*a* of lamp 12 acts to limit the flow of current and improve the power factor to the lamps 12 and 14 to a design value specified by the manufacturer. A resistor 32 of large value is connected in parallel across capacitor 30. Capacitor 34 which is wired in parallel with lamp filament coils 12*b* and 14*a* facilitates starting of the lamp fixture 10. A resistor 36 is connected in parallel across capacitor 34. Lead 38 is connected within the ballast 22 between one side of the AC line and heater filament coil 20, and serves as a ballast neutral. This reference is carried by lead 40 to filament 14*b* of lamp 14. The power reduction device 42 of the invention is preferably installed in lamp filament circuit 14*b;* it may be alternatively installed in circuit with lamp filament 12*a,* to reduce the current flow through both lamps 14 and 12 and thus reduce the power consumption of the fixture 10.

In the embodiment illustrated in FIG. 1, the power reduction device 42 consists essentially of a step-up isolation transformer 44 and a capacitor 46. The transformer primary winding 48 is connected in circuit in series with the filament heater coil 20 of ballast 22. The transformer secondary winding 50 is connected in circuit in series with the lamp filament 14*b* which is maintained at the neutral reference represented by the lead 38 of ballast 22. The connection of the power reduction device 42 in this electrical relationship with the ballast 22 has been found to present a more balanced load to the ballast circuitry, and is therefore employed in all embodiments described. The primary winding 48 and secondary winding 50 of the transformer 44 are provided with center tap connections 52 and 54 respectively. The capacitor 46 is therefore connected across the primary and secondary windings 48 and 50 of the transformer 44 in circuit in series with the ballast 22 and lamp filament 14*b* of lamp 14 and reduces the current in the circuit and therefore the power consumed by the fixture 10. A high value bleed resistor 56 is connected in parallel with capacitor 46. The capacitor/resistor combination is protected by a 90° C. thermal fuse 58. The resistor 56 allows capacitor 46 to discharge when the lamp fixture 10 is off, thus providing a safety feature for personnel handling the fixture. This design of the the circuitry of the power reduction device 42 permits the use of a single capacitor to provide the necessary reactance to reduce the current flow through the lamps 12 and 14 of the fixture 10, simplifying the circuit of the device both physically and electrically. Provision of a symmetrical load by the device 42 by virtue of the transformer windings center taps also eliminates any problem of lamp filament voltage fluctuations which could be caused by the different ways the device 42 could be randomly connected in the circuit of fixture 10.

In the device 42 illustrated and described, the transformer 44 has a step-up ratio of 1:1.4 between the primary and secondary windings 48 and 50 in order to maintain the proper voltage to heat the lamp filaments. However, a turns ratio of primary to secondary turns of from 1 to 1.1 through 1.7 has been found to be satisfactory. The capacitor 46 may have a value ranging from 1 to 8 microfarads depending upon the lamp configuration with a narrower preferred range of 5.2 to 5.4 microfarads. The resistor 56 performs satisfactorily with a resistance value of from 2 to 6 megohms. In the embodiments illustrated resistor 56 has a value of 2.4 megohms.

Figure 2:
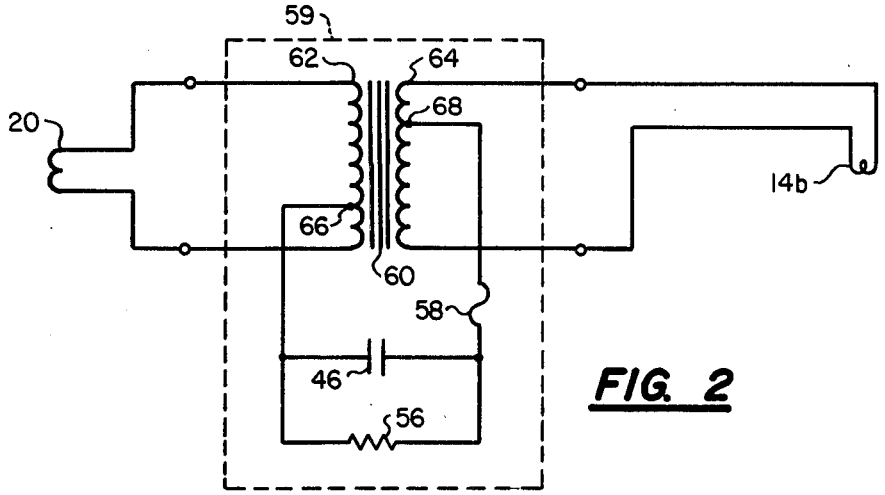
FIG. 2 illustrates schematically a modified circuit of the device of FIG. 1.

A variation of the internal circuit design of the power reduction device 42 is schematically illustrated by the device 59 in FIG. 2. The capacitor 46, resistor 56 and fuse 58 have the same values and functions as previously described in connection with the power reduction device 42 of FIG. 1. The transformer 60 has the same basic construction and turns ratio. However, the primary winding 62 and the secondary winding 64 of transformer 60 have intermediary taps 66 and 68 which are equally, but oppositely displaced from the center tap positions on their respective windings. The capacitor 46 and resistor 56 combination is connected between the intermediate transformer taps 66 and 68. Thus the device 59 presents a different, but symmetrical load to achieve the same results as the power reduction device 42 illustrated in FIG. 1.

Figure 3:
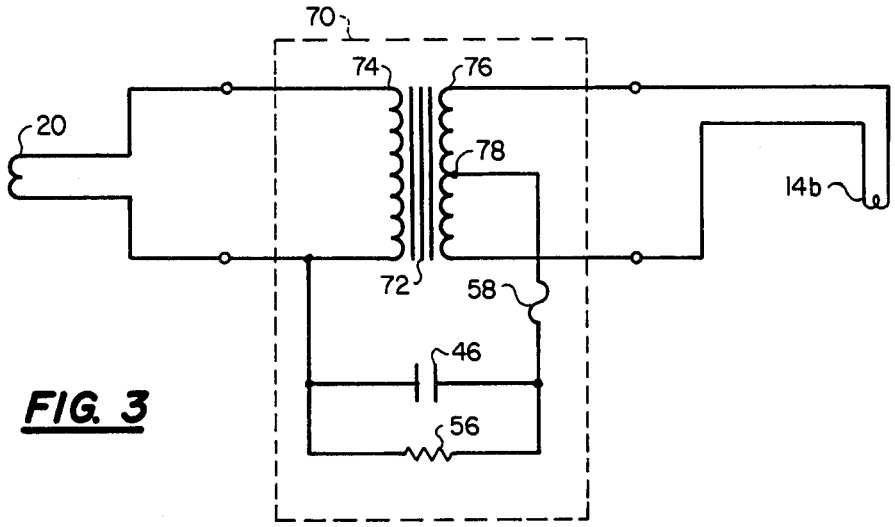
FIG. 3 illustrates schematically a second embodiment of the power reduction device.

A third embodiment of the power reduction device having a different internal circuit is illustrated at 70 in FIG. 3. Again the components are the same as the device of FIG. 1 except for the transformer and the connection of the capacitor 46 and resistor 56. As illustrated in FIG. 3, a transformer 72 is connected in series between the filament heater coil 20 and the filament 14*b* of lamp 14. However, the primary winding 74 of the transformer 72 does not have a tap, while the secondary winding 76 is provided with a center tap 78. The capacitor 46, resistor 56 and fuse 58 combination is connected between either lead of the transformer primary winding 74 and the secondary winding center tap 78. This design simplifies the construction of the transformer 72 without significantly sacrificing the desired symmetrical load characteristics of the power reduction device.

Figure 4:
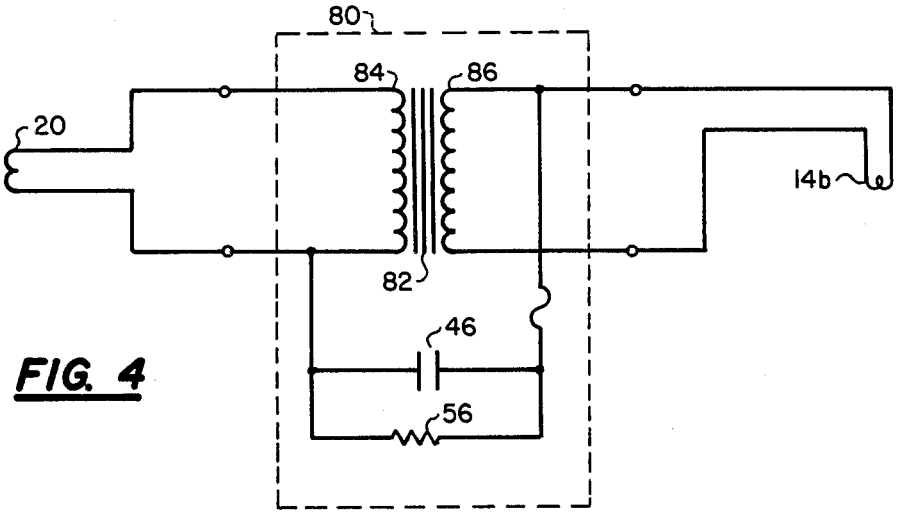
FIG. 4 illustrates schematically a third embodiment of the power reduction device.

A final illustrated embodiment of the power reduction device is depicted schematically at 80 in FIG. 4. Again, capacitor 46, resistor 56 and fuse 58 are the same as in the device 42 of FIG. 1. The transformer 82 has the same basic construction as before, but does not employ taps on either the primary winding 84 or the secondary winding 86. Instead, requisite symmetrical load characteristics for the device are achieved by connecting the capacitor 46 and resistor 56 combination between one primary winding input lead and the electrically opposite secondary winding output lead as schematically illustrated. This circuit arrangement permits the use of a transformer of simplified design and less cost.

Figure 5:
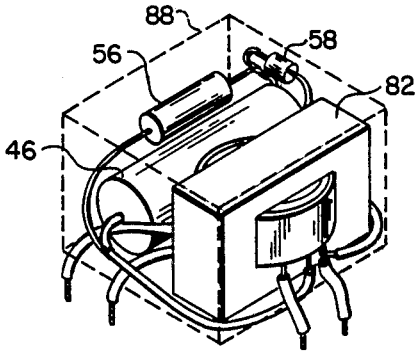
FIG. 5 is a perspective view of the packaged device of the invention.

FIG. 5 illustrates the mounting of the power reduction device components in a secure and rigid housing 88 for mounting on the lamp fixture 10 with clips or screws which are not shown. In FIG. 5, the mounting of transformer 82, capacitor 46, resistor 56 and fuse 58 of the power reduction device 80 of FIG. 1 in the housing 88 is illustrated.

Use of one of the described embodiments of the power reduction device of the invention in the circuit of lamp fixture 10 reduces the current and therefore the electrical power consumed by the lamps 12 and 14. The power reduction is achieved with acceptable and even distribution of fixture illumination. By virtue of the symmetry of the loads of the several embodiments of the invention, the risk of improper connection of the power reduction device in the lamp fixture circuitry and consequent low lamp filament voltage is overcome.

Modifications and variations of the present invention are possible in light of the above disclosure. It is therefore to be understood that within the scope of the pendant claims, the invention may be practiced other than as specifically described.

The invention having been described, what is claimed is:

1. A power reduction device for being wired in series between a rapid start ballast and a lamp filament of one of the lamps of a conventional two-lamp rapid start fluorescent lighting fixture to reduce the power consumed by the fixture, comprising:

a step-up isolation transformer having a primary winding with a pair of input leads and a secondary winding having a pair of output leads;

a capacitor;

a resistor connected in parallel across said capacitor;

means for connecting one side of said capacitor and resistor to said transformer primary winding; and symmetric connection means for connecting the other side of said capacitor and resistor to said transformer secondary winding and for causing the device to present substantially the same impedance in a lamp fixture circuitry independent of which of said input leads is connected to a respective one of a pair of ballast filament output leads.

2. A power reduction device as recited in claim 1 wherein said primary connection means and said symmetric secondary connection means comprises respective center tap connections on said transformer primary and secondary windings.

3. A power reduction device as recited in claim 1 wherein said primary connection means comprises an intermediate transformer primary winding connection, and said symmetric secondary connection means comprises:

an intermediate transformer secondary winding connection; and said primary and secondary winding intermediate connections are proportionately and oppositely displaced from the respective center turn positions of said primary and secondary windings.

4. A power reduction device as recited in claim 1 wherein said primary connection means comprises:

one of said pair of transformer primary winding input leads; and wherein said symmetric secondary connection means comprises an intermediate connection on on said transformer secondary winding.

5. A power reduction device as recited in claim 1 wherein said primary connection means comprises:

a first connection to one of said pair of transformer primary winding input leads; and wherein said symmetric secondary connection means comprises a second connection to one of said pair of transformer secondary winding output leads that is electrically opposite to said first connection.

6. A power reduction device as recited in claim 1 further comprising at least one thermal fuse connected in series with said capacitor and resistor.

7. A power reduction device as recited in claim 2, 3, 4 or 5 wherein the capacitance of said capacitor is in the range of from 1 to 8 microfarads and said resistor has a resistance value in the range of from 2.5 to 10 megohms.

8. A power reduction device as recited in claim 2, 3, 4 or 5 wherein the turns ratio of said step-up isolation transformer primary to secondary windings is in the range of from 1:1.1 to 1:1.7.

9. A power reduction device as recited in claim 7 wherein the capacitance of said capacitor is in the range of from 5.2 to 5.4 microfarads and said resistor has a value of 3 megohms.

10. A power reduction device as recited in claim 8 wherein the turns ratio of said step-up isolation transformer primary to secondary windings is 1:1.3.

11. A power reduction device for being wired in series between a rapid start ballast and a lamp filament of one of the lamps of a conventional two-lamp rapid start fluorescent lighting fixture to reduce the power consumed by the fixture, comprising:

a step-up isolation transformer having a primary winding with a pair of input leads and a secondary winding having a pair of output leads;

a capacitor;

a resistor connected in parallel across said capacitor;

connecting means for connecting one side of said capacitor and resistor to said transformer primary winding; and connecting means for connecting the other side of said capacitor and resistor to said transformer secondary winding;

at least one of said connecting means comprising a connection to an intermediate point on one of said transformer primary and secondary windings;

both of said connecting means comprising means for causing said device to present a substantially symmetric impedance in a lighting fixture circuit whichever way round said input leads are connected to a pair of ballast filament output leads.

* * * * *